US005423606A

United States Patent [19]

Milstead

[11] Patent Number: 5,423,606

[45] Date of Patent: Jun. 13, 1995

[54] BATCH ASPHALT PLANT HAVING RAP WEIGH HOPPER AND PUGMILL SCAVENGING SYSTEM

[75] Inventor: John Milstead, Chattanooga, Tenn.

[73] Assignee: Astec Industries, Inc., Chattanooga, Tenn.

[21] Appl. No.: 163,894

[22] Filed: Dec. 7, 1993

[51] Int. Cl.[6] ..... B28C 5/46; B28C 5/38

[52] U.S. Cl. ..... 366/7; 366/18; 366/23; 366/33

[58] Field of Search ..... 366/18, 33, 34, 40, 366/25, 24, 23, 4, 1, 6, 7, 8; 106/273.1, 276, 277

[56] References Cited

U.S. PATENT DOCUMENTS

| | | | |
|---|---|---|---|
| 2,967,696 | 1/1961 | Mauldin | 366/25 |
| 3,484,083 | 12/1969 | Albertini | 366/22 |
| 3,661,365 | 5/1972 | Cloud, Jr. . | |
| 3,949,907 | 4/1976 | Mize . | |
| 4,579,458 | 4/1986 | Ohlson | 366/18 |
| 4,943,200 | 7/1990 | Edwards et al. . | |
| 4,944,646 | 7/1990 | Edwards et al. . | |
| 4,993,839 | 2/1991 | Brock . | |
| 5,090,813 | 2/1992 | McFarland | 366/23 |
| 5,251,976 | 10/1993 | Milstead . | |

OTHER PUBLICATIONS

Astec Product Line—Batch Tower.
The Batch Tower, Feb. 1988.

*Primary Examiner*—Robert W. Jenkins
*Attorney, Agent, or Firm*—Nilles & Nilles

[57] ABSTRACT

A designated amount of recycled asphalt product (RAP) is fed to the pugmill of a batch asphalt plant during the production of hot mix asphalt (HMA) at a controlled rate so as not to overload the pugmill scavenging system. The designated amount of RAP is metered in a RAP weigh hopper, stored temporarily in a RAP holding hopper, and is then fed from the RAP holding hopper to the pugmill at a controlled rate. The feed of RAP to the pugmill, though electronically initiated, is preferably manually or automatically adjustable so as to avoid overloading the pugmill scavenging system while at the same time assuring adequate mixing of the RAP with the virgin aggregate and liquid asphalt. The scavenging system directs vapors removed from the pugmill to the dryer and preferably includes electronically operated dampers connecting the combustion air inlet of the dryer to the pugmill only during the mixing operation and otherwise connecting the combustion air inlet to the ambient atmosphere.

25 Claims, 7 Drawing Sheets

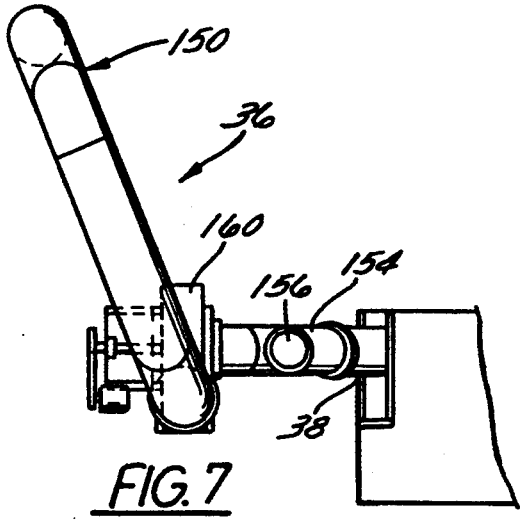
FIG. 7
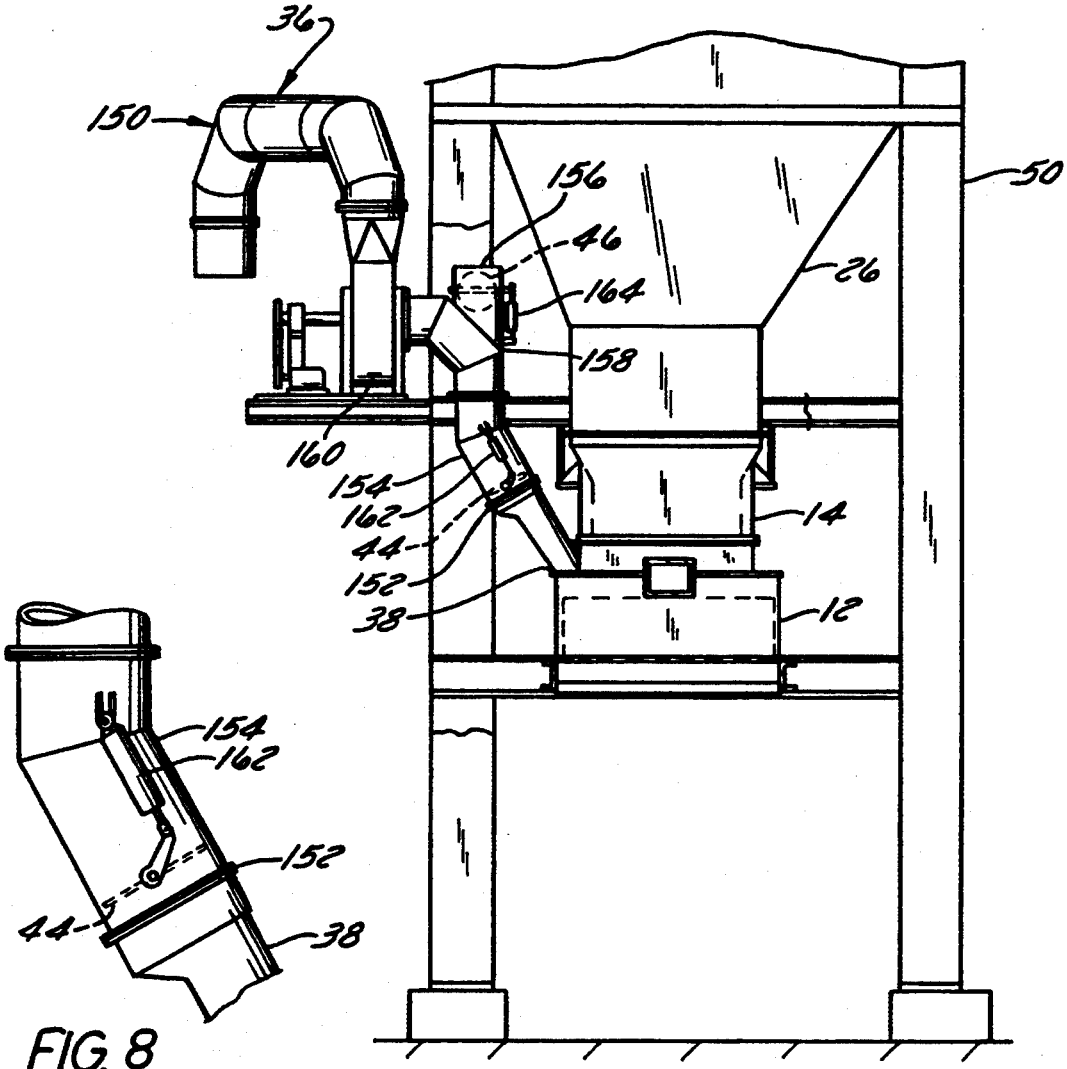
FIG. 8
FIG. 5

BATCH ASPHALT PLANT HAVING RAP WEIGH HOPPER AND PUGMILL SCAVENGING SYSTEM

BACKGROUND OF THE INVENTION

1. Field of the Invention

The invention relates to batch asphalt plants and, more particularly, relates to a batch asphalt plant capable of producing batches of hot mix asphalt (HMA) each having a percentage of recycled asphalt products (RAP).

2. Discussion of the Related Art

Batch asphalt plants are well-known for the production of discrete amounts or batches of HMA. Such plants typically include a drum dryer for heating and drying stone aggregate, a tower, and an enclosed vertical bucket elevator for conveying the heated and dried aggregate from the dryer onto vibrating deck screens which are mounted on top of the tower and which segregate the aggregate by size. Chutes direct the segregated aggregate to bins which underlie the screens such that each bin receives an aggregate of a predetermined average size. A weigh hopper is positioned below the bins and permits the aggregate from one or more bins to be weighed out to provide a designated amount of a desired mixture. The characteristics of such mixtures may vary, e.g. from a roadway base coat to a finish coat. A pugmill is positioned beneath the weigh hopper for mixing the aggregate with liquid asphalt. HMA is dumped into an underlying truck from a gate located at the bottom of the pugmill, and vapors are evacuated from the top of the pugmill and conveyed to a baghouse by a scavenging system.

The use of recycled asphalt product (RAP) is often desirable in the manufacturer of HMA. Two methods of adding RAP to HMA in batch plants have heretofore been employed.

The first method involves the addition of limited percentages of RAP to the virgin aggregate in the vertical bucket elevator conveying virgin aggregate from the dryer to the tower. This method, though relatively simple, is poorly suited for use with batch asphalt plants for several reasons. For example, only limited amounts of RAP can be added to the virgin aggregate without clogging the deck screens above the bins or otherwise interfering with the flow of materials into or from the bins. In addition, there is no way of varying the percentage of RAP in a given HMA batch since each batch of RAP is disbursed throughout the material in the bins and since not all bins are used to supply material to every batch.

The second method of adding RAP to HMA in batch plants involves the direct feed of RAP to the pugmill. This second method permits the use of higher percentages of RAP since there is no danger of clogging screens or otherwise interfering with the flow of materials into downstream components of the system. This method also permits the percentage of RAP to be varied from batch to batch since all of the RAP introduced into the pugmill is in each instance mixed directly with the final product. However, this method exhibits a rather severe drawback in that, when the RAP is added to the hot virgin aggregate in the pugmill, a virtual explosion of steam and dust results from the rapid vaporization of the moisture in the RAP. The typical pugmill scavenging system is designed to handle only the average production of dust and steam from a normal mixing process and thus may well be overwhelmed by the explosive vaporization of moisture from the RAP. Uncontrolled introduction of RAP into the pugmill could thus result in overloading of the scavenging system and the release of potentially harmful pollutants to the atmosphere. This problem could heretofore be avoided only by grossly oversizing the capacity of the scavenging system, by drying the RAP prior to its introduction into the pugmill, or by limiting the percentages of RAP to limit steam production to acceptable levels. Each of these techniques is undesirable for cost and/or operational reasons. The need has therefore arisen to provide a batch asphalt plant capable of mixing a desired quantity of RAP in each production batch in a more desirable manner.

The traditional scavenging process exhibits several drawbacks and disadvantages. For instance, both the gases and particulates conveyed to the baghouse by the scavenging system have relatively high levels of hydrocarbon concentrations. These hydrocarbons could condense in the baghouse and cause a fire hazard. The need has therefore arisen to handle safely materials scavenged from the pugmill of a batch asphalt plant.

Another problem associated with conventional batch asphalt plants is the inability of such plants to adequately handle materials scavenged from the pugmill by the scavenging system. These materials typically include a mixture of steam, gases, and dust which are conveyed via a ductwork assembly of the scavenging system from the pugmill to a baghouse where the particulates are separated from the gases.

OBJECTS AND SUMMARY OF THE INVENTION

It is therefore an object of the invention to provide a system for the addition of relatively large percentages of RAP to the pugmill of a batch asphalt plant in a controlled manner to limit the production of steam and dust to concentration levels which can be handled by a reasonably sized scavenging system.

In accordance with a first aspect of the invention, a batch asphalt plant for producing HMA using a percentage of RAP is provided which includes a hot virgin aggregate storage bin, a pugmill which receives virgin aggregate from the storage bin, a RAP storage system positioned in the vicinity of the pugmill, and conveyor means for feeding RAP from the RAP storage system to the pugmill at a controlled, variable rate. The means for feeding preferably comprises a variable speed conveyor which transports RAP from the RAP storage system to the pugmill. The RAP storage system preferably comprises a RAP weigh hopper which stores a designated amount of RAP, a RAP holding hopper positioned between the RAP weigh hopper and the variable speed conveyor, and gate means for selectively permitting RAP in the RAP weigh hopper to flow into the RAP holding hopper. The RAP weigh hopper preferably includes load cells which detect the weight of RAP in the RAP weigh hopper.

Another object of the invention is to provide a method of manufacturing HMA including feeding RAP into the pugmill so as to avoid overloading a pugmill scavenging system while at the same time adding relatively high percentages of wet RAP to the mix.

In accordance with another aspect of the invention, this object is achieved by providing a method of producing HMA which includes feeding a designated amount of heated virgin aggregate to a pugmill, feeding RAP to the pugmill at a controlled, variable rate, mixing the heated virgin aggregate and the RAP in the pugmill and adding liquid asphalt as required to produce .the HMA, and discharging the HMA from the pugmill. Preferably, the rate at which RAP is fed to the pugmill can be manually adjusted. The feeding step preferably comprises storing RAP in a RAP weigh hopper, feeding the RAP from a RAP weigh hopper to a RAP holding hopper, and actuating a variable speed conveyor to convey the RAP from the RAP holding hopper to the pugmill. The storing step preferably includes feeding rap into a RAP weigh hopper, detecting the amount of RAP in the RAP weigh hopper, and terminating the feed of RAP to the RAP weigh hopper upon the detection of a designated amount of RAP in the RAP weigh hopper.

Still another object of the invention is to provide a pugmill scavenging system which is capable of providing a controlled feed of scavenged vapors from the pugmill directly to a combustion zone of a dryer or the like.

Still another object of the invention is to provide a method of controlling the injection of combustion air to a dryer of a batch asphalt plant selectively using scavenged vapors as a source of combustion air.

Pursuant to yet another aspect of the invention, these objects are achieved by providing a vapor scavenging system including a ductwork assembly having an inlet connected to a pugmill and an outlet connected to a combustion zone defined by a shroud surrounding a burner, and a blower which draws vapors from the pugmill, through the ductwork, and into the burner. The ductwork assembly preferably has a second inlet connected to the ambient atmosphere, and the system further comprises first and second dampers which control the flow of gases from the first and second inlets of the ductwork assembly to the outlet. The burner preferably comprises a dryer supplying heated and dried aggregate to the pugmill.

Means are preferably provided for correlating damper operation such that the second damper is closed when the first damper is open. The means for correlating preferably comprises a manually adjustable timer which determines the period for which the first damper is open and the second damper is closed.

Other objects, features, and advantages of the invention will become apparent to those skilled in the art from the following detailed description and accompanying drawings. It should be understood, however, that the detailed description and specific examples, while indicating preferred embodiments of the invention, are given by way of illustration and not of limitation. Many changes and modifications within the scope of the present invention may be made without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which:

FIG. 5 is an end view of the:scavenging system of FIGS. 1 and 3, viewed from the front of the system;

FIG. 7 is a plan view of the scavenging system of FIGS. 5 and 6;

FIG. 8 is a detail view of a damper assembly of the scavenging system of FIGS. 5–7.

DETAILED DESCRIPTION OF THE PREFERRED EMBODIMENTS

Resume

Pursuant to the invention, a designated amount of recycled asphalt product (RAP) is fed to the pugmill of a batch asphalt plant during the production of hot mix asphalt (HMA) at a controlled rate so as not to overload the pugmill scavenging system. The designated amount of RAP is metered into a RAP weigh hopper, stored temporarily, and is then fed to the pugmill at a controlled rate. The feed of RAP to the pugmill, though electronically initiated, is preferably manually or automatically adjustable so as to avoid overloading the pugmill scavenging system while at the same time assuring adequate mixing of the RAP with the virgin aggregate and liquid asphalt. The scavenging system directs vapors removed from the pugmill to the dryer. The scavenging system preferably includes electronically operated dampers connecting the combustion air inlet of the dryer to the pugmill only during the mixing operation and otherwise connecting the combustion air inlet to the ambient atmosphere.

System Overview

Figure 1:
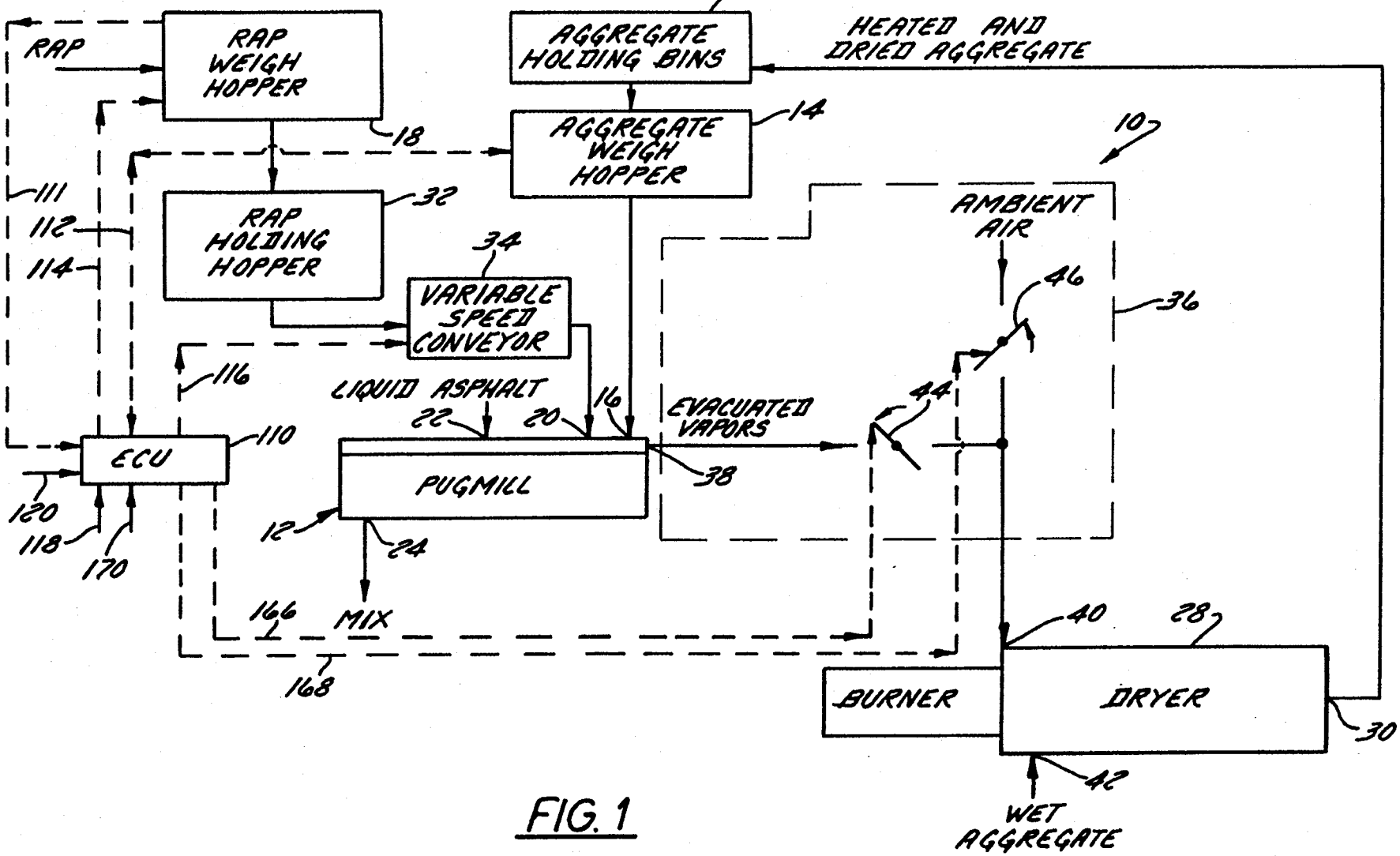
FIG. 1 is a schematic view of a batch asphalt plant constructed in accordance with a preferred embodiment of the invention.
Figure 2:
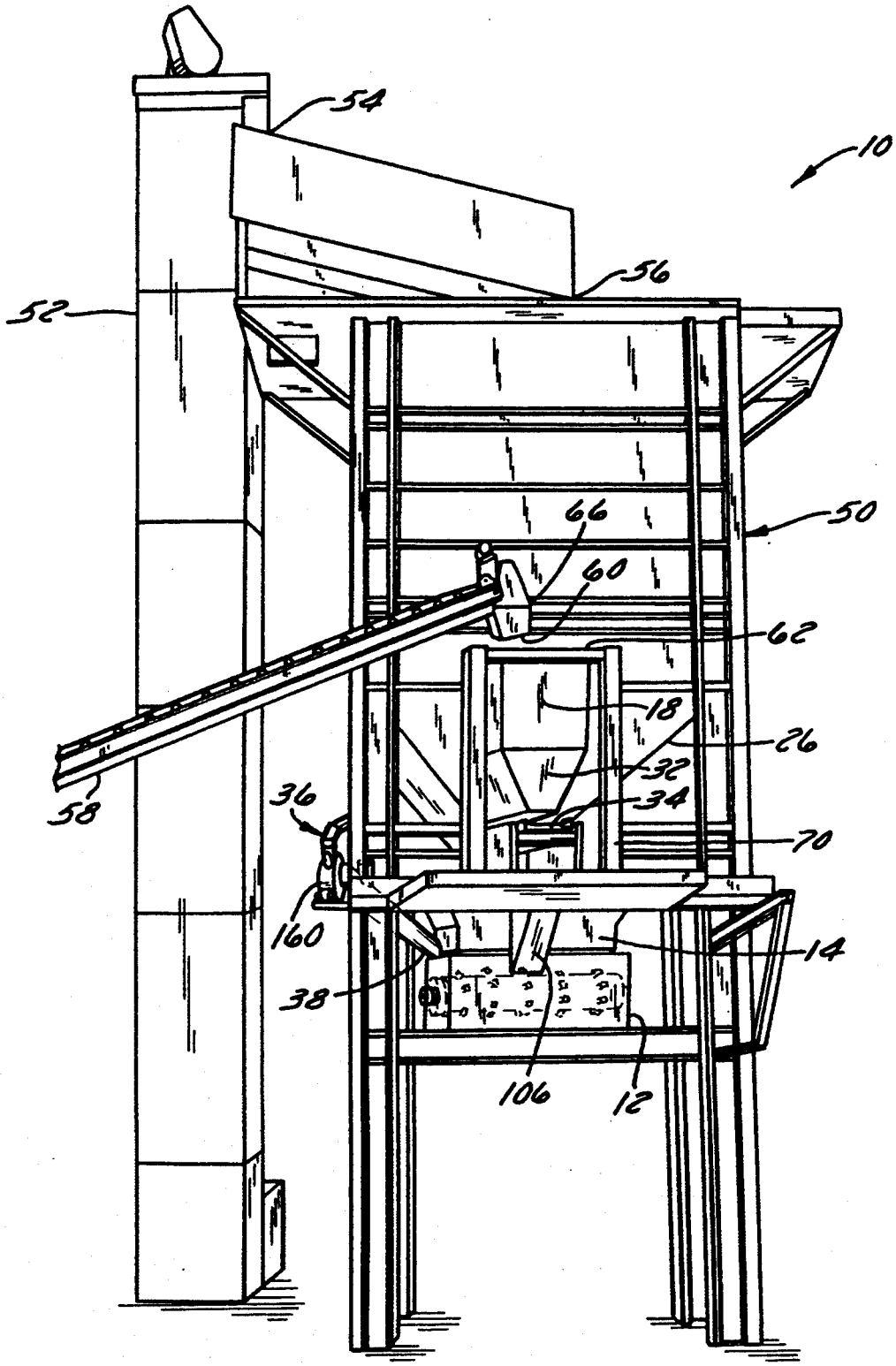
FIG. 2 is a perspective view of a portion of the system of FIG. 1.

Referring now to FIG. 1, a batch asphalt plant 10 constructed in accordance with the preferred embodiment of the present invention includes as its major components a pugmill 12; a virgin aggregate feed system including an aggregate weigh hopper 14 and a plurality of aggregate storage bins 26; a RAP feed system including rap weigh hopper 18, a RAP holding hopper 32, and a variable speed conveyor 34; an aggregate dryer 28; and a scavenging system 36. The pugmill 12 has inlets 16, 20, and 22 connected to the aggregate weigh hopper 14, the variable speed conveyor 34, and a source of liquid asphalt (not shown), respectively. Pugmill 12 also has a HMA outlet 24 as well as a vapor outlet 38 connected to an inlet of scavenging system 36 the outlet of which is connected to a combustion air inlet 40 of the dryer 28. Operation of the various components of the plant 10 is monitored and controlled by an electronic control unit (ECU) 110. Many system components, and particularly the RAP feed system and scavenging system 36, are illustrated in detail in other drawings and for clarity are only schematically illustrated in FIG. 1.

Pugmill 12 may comprise any device capable of mixing aggregate, RAP, and liquid asphalt to form HMA. A particularly preferred pugmill is a so-called twin-screw pugmill having parallel rotatable shafts each having a plurality of hardened paddles mounted thereon. Dryer 28 similarly may comprise any device capable of heating and drying virgin aggregate. A counterflow rotary drum dryer is preferred. The pugmill 12, aggregate weigh hopper 14, and aggregate holding bins 26 are typically mounted in a tower. The RAP feed system including the RAP weigh hopper 18, RAP holding hopper 32, and variable speed conveyor 34 is preferably mounted on the exterior of the same tower.

In use, wet virgin aggregate is fed to an aggregate inlet 42 of dryer 28 where it is heated and dried by a burner 29 before being discharged from outlet 30. The heated and dried aggregate is fed to the tower 50 and sorted through suitable deck screens so that each of the holding bins 26 receives aggregate of a certain grade. Prior to mixing, designated amounts of aggregate from some or all of the bins 26 are fed into the aggregate weigh hopper 14 in a manner which is, per se, well known, while a designated amount of RAP is simultaneously fed to RAP weigh hopper 18.

To initiate mixing, aggregate in the aggregate weigh hopper 14 and RAP in the RAP weigh hopper 18 are simultaneously discharged to the inlet 16 of pugmill 12 and to the RAP holding hopper 32, respectively. RAP is then fed from RAP holding hopper 32 into inlet 20 of pugmill 12 at a controlled rate by the variable speed conveyor 34. Liquid asphalt is also injected into inlet 22 of pugmill 12 and mixed with the RAP and aggregate to produce the HMA, which is then discharged from pugmill outlet 24. Vapors produced during this mixing are evacuated from pugmill 12 and fed to the combustion air inlet 40 of dryer 28 by scavenging system 36.

CONSTRUCTION AND OPERATION OF VIRGIN AGGREGATE AND RAP FEED SYSTEMS

Referring now to FIGS. 1–5, the pugmill 12 and the virgin aggregate feed system, composed of the aggregate weigh hopper 14 and aggregate holding bins 26, are mounted in a tower 50. The RAP feed system 64 formed from the RAP weigh hopper 18, RAP holding hopper 32, and variable speed conveyor 34 is mounted on the exterior of tower 50 via a support structure 70. An enclosed vertical bucket elevator 52 is positioned adjacent the tower 50 and has an outlet 54 emptying into an inlet 56 located above the top of the tower 50. An inclined conveyor 58 is also positioned adjacent the tower 50 and has an outlet 60 emptying into an upper inlet 62 of RAP weigh hopper 18.

The virgin aggregate feed system composed of the aggregate weigh hopper 14, aggregate holding bins 26, and elevator 52 is, per se, well known. These elements and associated elements such as deck screens positioned between the upper opening 56 of tower 50 and the aggregate holding bins 26 will not be described in greater detail.

The RAP feed system 64 including the weigh hopper 18, RAP holding hopper 32, variable speed conveyor 34, and inclined conveyor 58 is designed to meter and store temporarily a designated volume of RAP and to feed RAP to the pugmill 12 at a controlled rate upon demand. RAP feed system 64 is essentially self-contained and is connected to a conventional batch asphalt plant only by a chute 106 (detailed below) and by support structure 70 and thus can be easily retrofitted onto an existing batch asphalt plant. RAP weigh hopper 18 and RAP holding hopper 32 may be more properly considered a RAP storage system or subsystem because their primary function is to temporarily store RAP for subsequent feed to the pugmill 12.

Conveyor 58 could be any suitable conveyor capable of feeding RAP to the RAP weigh hopper 18. Preferably, conveyor 58 is a belt-type conveyor driven by an electric motor having brakes permitting it to stop essentially instantaneously upon demand, thus controlling precisely the feed of materials from the conveyor 58 to the RAP weigh hopper 18. The direction at which RAP is fed from the outlet 60 of the conveyor 58 to the RAP weigh hopper 18 can be adjusted as required by altering the position of the spout 66 via actuation of a pneumatic cylinder 68.

Figure 3:
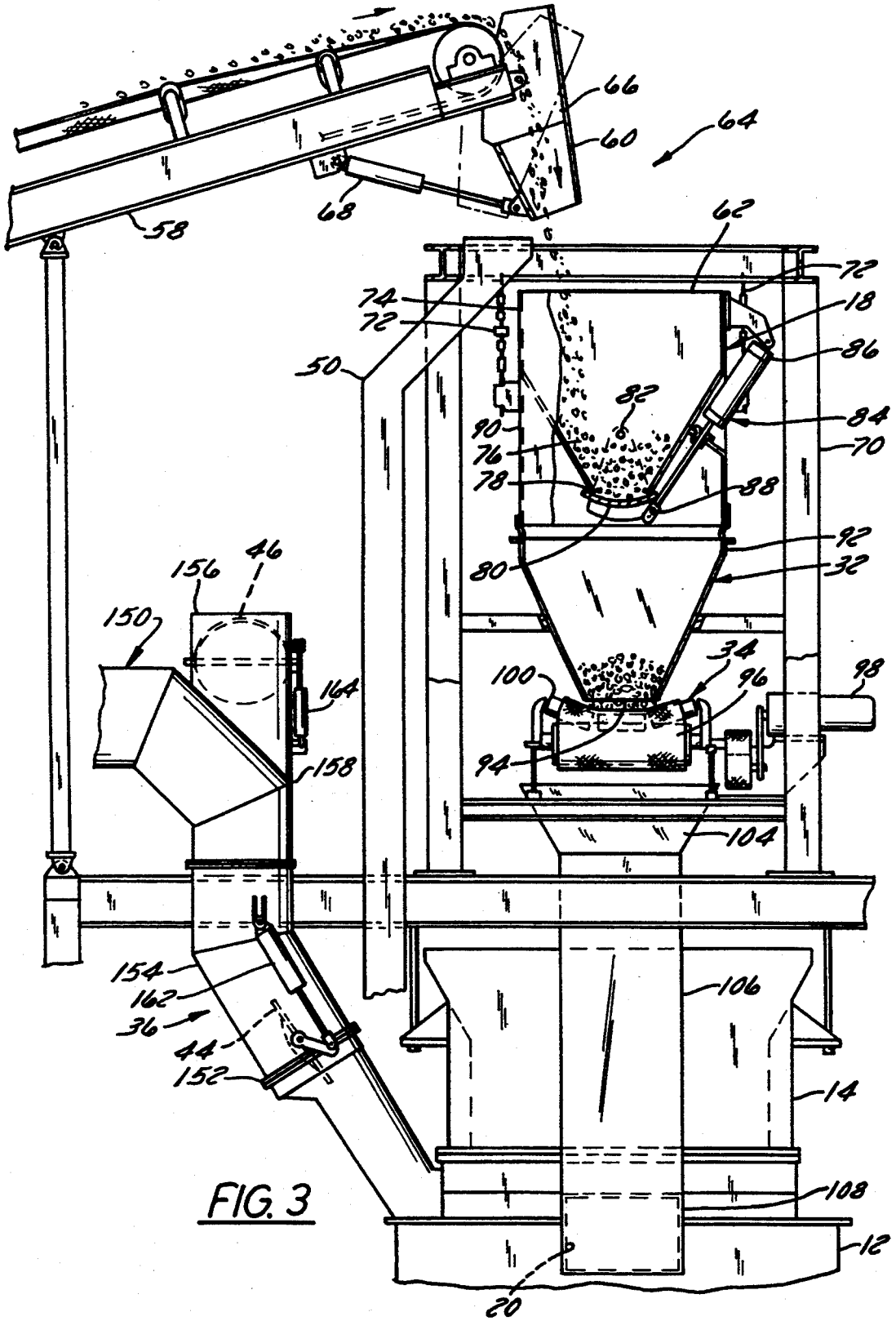
FIG. 3 is an end elevation view of the RAP feed system of FIGS. 1 and 2 and of a portion of the scavenging system.
Figure 4:
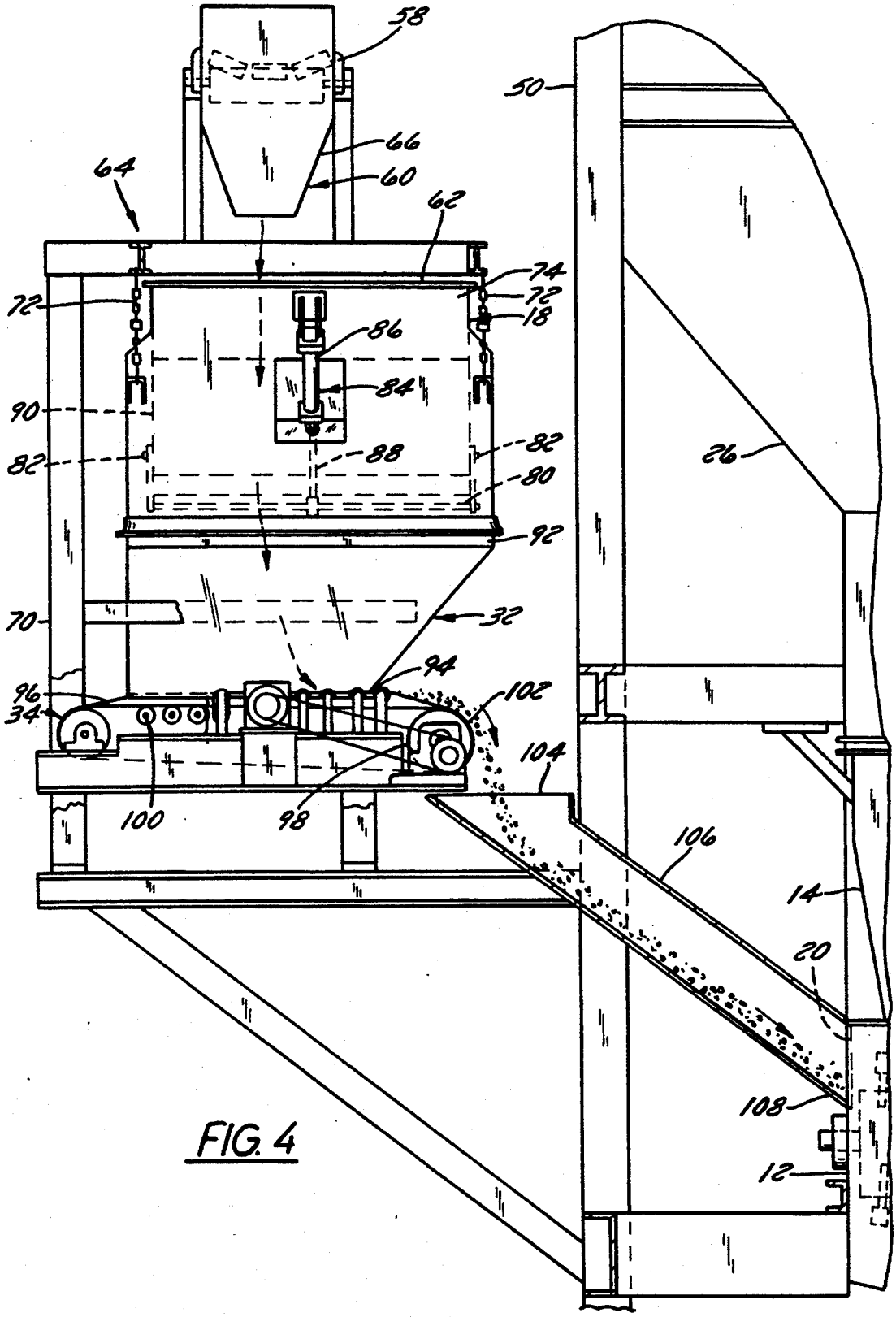
FIG. 4 is a side view of the RAP feed system of FIG. 3.
Figure 6:
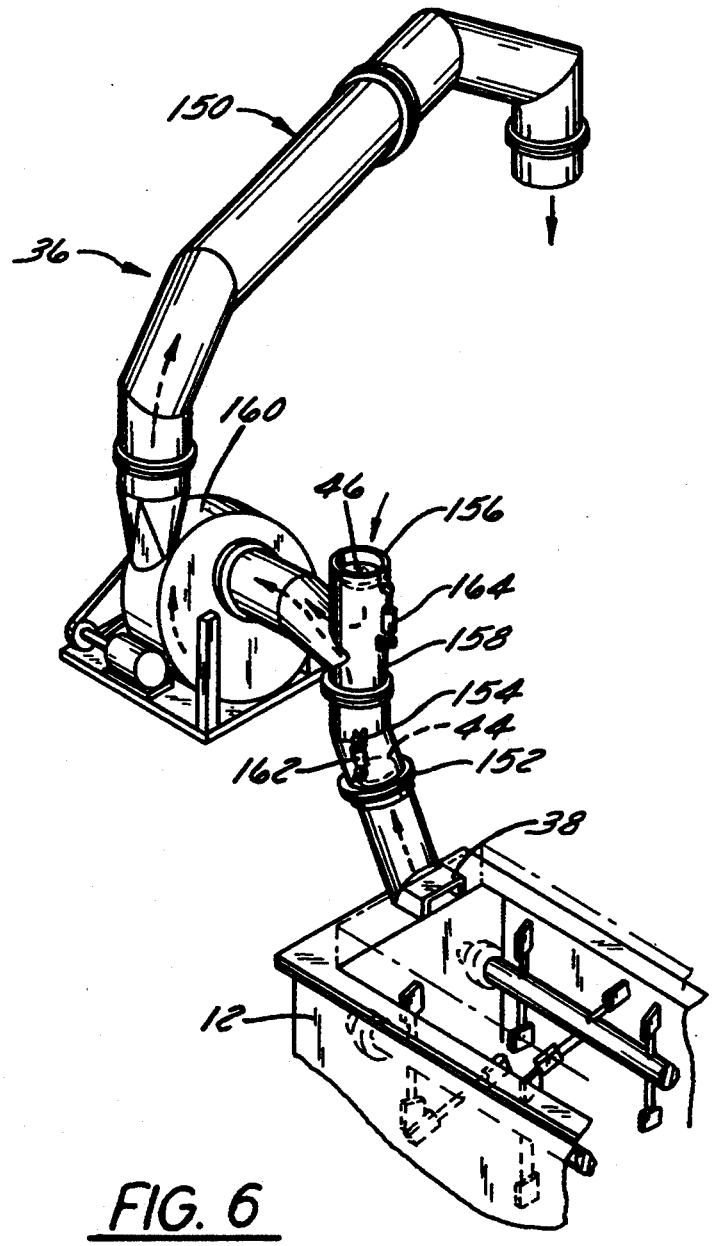
FIG. 6 is a perspective view,generally corresponding to FIG. 5 but viewed from behind and above the system.
Figure 9:
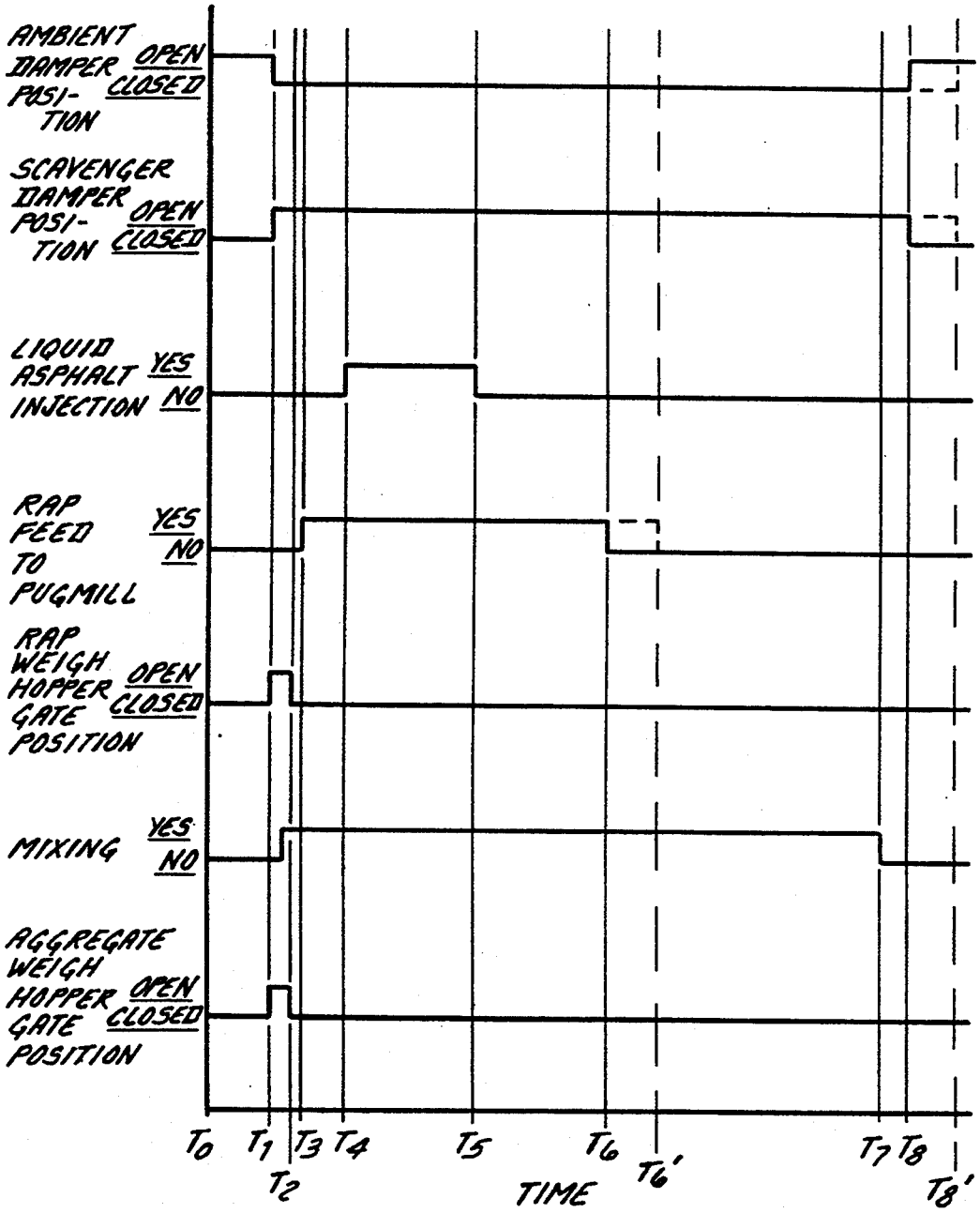
FIG. 9 is a timing chart illustrating the operation of the batch asphalt plant of FIGS. 1–8.

RAP weigh hopper 18 is designed to interact with conveyor 58 to receive and store a designated amount of RAP. To this end, hopper 18 is suspended from support structure 70 by load cells 72 which detect the instantaneous weight of hopper 18. Referring to FIGS. 3 and 4, RAP weigh hopper 18 has an open top forming an inlet 62, a cylindrical upper portion 74, and a frusto-conical lower portion 76 terminating in a discharge opening 78 normally closed by a gate 80. Gate 80 preferably comprises a clam gate pivotally mounted to the hopper 18 at pivot points 82. An electronically actuated pneumatic cylinder 84 is connected at its cylinder end 86 to the upper portion 74 of hopper 18 and at its piston end 88 to the gate 80 so as to open the gate upon retraction. An outer shell 90 surrounds the hopper portions 74 and 76 and slidably receives the piston 88 of pneumatic cylinder 84.

RAP holding hopper 32 is designed to facilitate the feed of RAP from the RAP weigh hopper 18 to the conveyor 34. To this end, RAP holding hopper 32 is generally frusto-conical in shape and is attached at its upper end 92 to the lower end of the shell 90 of the RAP weigh hopper 18. Hopper 32 is supported on a cross bar 91 of support structure 70 and is operatively connected to the RAP weigh hopper 18 by a flexible seal 93. Hopper 32 is open at its upper end 92 so as to receive materials from the discharge opening 78 of the RAP weigh hopper 18 and is also open at its lower end 94 so as to supply materials to the conveyor 34.

Conveyor 34 could be any device capable of transferring materials from the holding hopper 32 to the pugmill 12 at a controlled, variable rate. For instance, conveyor 34 could be a variable speed screw or a variable orifice gate. The conveyor 34 of the illustrated embodiment takes the form of a continuous belt 96 driven by a variable speed electric motor 98 which, together with the associated drive system, forms a variable speed drive with a 10:1 turn down ratio. Belt 96 is supported on a plurality of rollers 100 such that the lateral edges of the belt 96 are slanted upwardly so as to direct materials on the belt towards its longitudinal center. A discharge end 102 of belt 96 cooperates with an inlet 104 of an inclined chute 106, the outlet 108 of which empties into the inlet 20 of pugmill 12.

The sequential feed of virgin aggregate, RAP, and liquid asphalt to the pugmill 18 is controlled electronically via ECU 110 or the like so as to provide optimum mixing of materials in the pugmill to produce HMA without overloading the scavenging system 36. One such operation will now be described.

Referring now to FIGS. 1–5 and 9, batches of HMA are produced by feeding heated and dried aggregate via the elevator 52 from the outlet 30 of dryer 28 to the deck screens positioned above the aggregate holding bins 26. The screens grade the aggregate such that each of the plurality of holding bins 26 stores aggregate of a designated grade. Designated amounts of aggregate are then fed to the aggregate weigh hopper 14 from a selected combination of the storage bins 26 in a manner which is, per se, well known. A designated amount of RAP is likewise fed into the RAP weigh hopper 18 via operation of the conveyor 58, which terminates the feed of RAP when the load cells 72 detect that the designated amount of RAP has been fed into the hopper 18. Specifically, when load cells 72 detect that the designated amount of RAP has been fed into hopper 18, they transmit an electronic signal 111 (FIG. 1) to ECU 110, which in turn transmits a signal to conveyor 58 which deactivates the conveyor motor and applies the motor's brake. All of this takes place prior to the time $T_0$ in FIG. 9.

The mixing cycle is initiated at time $T_1$ by the transmission of signals 112 and 114 from ECU 110 to open simultaneously the gate of the aggregate weigh hopper 14 and the gate 80 of the RAP weigh hopper 18. By time $T_2$, all of the aggregate in the aggregate weigh hopper 14 is emptied into the pugmill 12, and all of the RAP in the RAP weigh hopper 18 is emptied into the holding hopper 32. The RAP weigh hopper gate 80 and the corresponding gate of the aggregate weigh hopper are then closed by the ECU 110 so that the weigh hoppers 14 and 18 can be refilled for the production of the next batch.

Simultaneously with the opening of the gates for the RAP weigh hopper 18 and aggregate weigh hopper 14, ECU 110 transmits a signal 116 which energizes motor 98 of conveyor 34, thus initiating the feed of RAP to the pugmill 12. RAP is then fed into the pugmill 12 continuously from time $T_3$ to time $T_6$ at a rate determined by the speed of motor 98.

The period $T_3$–$T_6$ over which RAP is fed into pugmill 12 to $T_6$ is set so as to avoid the overloading of the scavenging system 36 while at the same time assuring that all of the RAP remains in the pugmill 12 for a sufficient amount of time to provide uniform mixing, aggregate coating, and moisture vaporization. For instance, if the batch to be produced is to contain 16,000 pounds of HMA with 15% RAP having 5% moisture content, feeding of the RAP to the pugmill 12 will produce 3,960 $ft^3$ of steam (2,400 lbs. of RAP×0.05 lbs. of water/lb. of RAP×33 $ft^3$ of steam/lb. of water). Since the illustrated scavenging system is capable of evacuating 250 $ft^3$ cubic feet of steam/second, the RAP is fed into the pugmill 12 over a period $T_3$–$T_6$ of about 16 seconds (3,960 $ft^3$ divided by 250 $ft^3$ per second).

During the introduction of the RAP into the pugmill 12, liquid asphalt is injected over a period $T_4$ to $T_5$ beginning 2–3 seconds into the mixing cycle and lasting about 6–7 seconds. Since the RAP is dry mixed with the virgin aggregate for a period of about 2–3 seconds ($T_3$ to $T_4$) before the injection of liquid asphalt, the feed of RAP to the pugmill 12 is about ½–⅔ complete by the time the liquid asphalt injection is completed at time $T_5$.

Mixing continues after termination of RAP feed at time $T_6$ until the HMA is adequately mixed at time $T_7$. Adequate mixing occurs when (1) the aggregate composition is mixed, (2) the aggregate is coated with liquid asphalt, and (3) substantially all of the water in the RAP is vaporized. In reality, aggregate mixing takes place relatively quickly such that the major time constraints on a mixing cycle are aggregate coating and RAP water vaporization. However, since RAP is already coated with liquid asphalt, it need not be coated during the mixing cycle. Moreover, it has been found that mixing RAP with heated virgin aggregate for about 20 seconds will evaporate substantially all of the water! in the RAP. The mixing period $T_5$ to $T_7$ can thus be set at 30 seconds (the time required for virgin aggregate coating) even though not all of the RAP has been fed into the pugmill at time $T_5$. The 5–10 second delay between $T_5$ and $T_6$ thus does not lengthen the mixing cycle. This is important because process demands require that a new batch be available about every 60 seconds.

AS mentioned above, the time period $T_3$ to $T_6$ during which RAP is fed to the pugmill 12 is controlled by controlling the speed of the variable speed conveyor 34. Preferably, this speed is preset to provide a designated RAP feed period based upon predetermined system parameters as described above. This time period could be programmed into the ECU 110 or could be calculated by the ECU 110 using data input via a programmable input 118 relating to estimated or measured RAP moisture content and desired RAP batch size.

Means should also be provided for adjusting the feed rate of RAP into the pugmill 12 so as to compensate for any inaccuracies in the rate determined by or preset in ECU 110. Thus, a manually operated dial is preferably connected to the ECU 110 via an input signal 120 to permit manual control of the cycle. This control permits the operator to observe the amount of steam being produced during a mixing cycle and to adjust the speed of conveyor 34 to increase the next RAP feed period as may be required to avoid overloading of scavenging system 36. Thus, referring again to FIG. 9, if an operator observes that an unacceptably high level of steam is produced during a given mixing cycle, the operator may adjust the speed of conveyor 34 by inputting signal 120 such that termination of RAP feed in the next cycle is delayed until a time $T_6'$. The control of the remaining components of the system would not be affected by this operation.

It can thus be seen that the controlled feed of RAP into the pugmill 12 significantly reduces the rate at which steam is produced during a mixing cycle, even upon the feed of a relatively large percentage of RAP into the mix, and permits a reasonably sized scavenging system to remove the steam and dust from the pugmill.

In addition to controlling the feed of RAP into the asphalt plant 10, measures are also preferably taken to simplify handling of scavenged steam, dust, and gases (hereafter collectively referred to as "vapors") by feeding these vapors into the combustion chamber of the aggregate dryer 28. One such scavenging system will now be described.

CONSTRUCTION AND OPERATION OF SCAVENGING SYSTEM

Referring now to FIGS. 1, 2, and 5–9, the vapor scavenging system 36 includes a ductwork assembly 150, a blower 160, and dampers 44, 46. Ductwork assembly 150 connects the outlet 38 of pugmill 12 to the inlet 40 of dryer 28 and has first and second inlets 152 and 156 and an outlet (not shown). The first inlet 152 forms the end of a first branch 154 of ductwork assembly 150 and is connected to the vapor outlet 38 of pugmill 12. The second inlet 156 is formed on the end of a second branch 158 of the ductwork assembly 150 and communicates with the ambient atmosphere. The blower 160 draws air from a selected one of the inlets 152 and 156 through the outlet of assembly 150 and into the combustion air inlet 40 of dryer 28.

Dampers 44 and 46 are located in the branch conduits 154 and 158 of the ductwork assembly 150 and control the flow of air to the blower 160 by selectively opening and closing the inlets 152 and 156. Dampers 44 and 46 could be manually operated but preferably are electronically controlled so that their operation is correlated with one another and with the mixing cycle. To this end, dampers 44 and 46 are operated by electronically controlled pneumatic cylinders 162 and 164 which receive actuating signals 166 and 168 from ECU 110 (FIG. 1) under the control of a timer. The timer may be either a timing function programmed into ECU 110 or an exterior timer connected to the ECU so as to transmit signals 170 to ECU 110.

The operation of scavenging system 36 will now be described with reference to FIGS. 1, 3, and 5–9. Blower 160 operates at all times during plant operation to supply combustion air to the inlet 40 of dryer 28. Dampers 44 and 46 are actuated by the ECU 110 under the control of the timer (not shown) to feed scavenged vapors from the pugmill 12 to the blower 160 during the mixing cycle and to otherwise feed ambient air to the blower. The timing sequence is initiated by the generation of signal 170 by the timer when the mixing cycle is initiated at time $T_1$ and continues and terminates independently of the mixing cycle. Specifically, at time $T_1$, the timer is triggered and transmits the signal 170 to ECU 110, which in turn transmits a signal 166 which opens damper 44 and a signal 168 which closes the damper 46, thus isolating the interior of the ductwork assembly 150 from the atmosphere and permitting the feed of vapors from the pugmill 12 to the combustion chamber of the dryer 28. The dampers 44 and 46 remain in this position throughout the mixing cycle—and typically slightly beyond the mixing cycle—so that, when the signal 170 is terminated and the dampers returned their initial positions at time $T_8$ upon expiration of the period set by the timer, substantially all of the vapors generated in the pugmill 12 are evacuated to the dryer 28 without escaping to the atmosphere.

Although the timer generating signal 170 is preferably preset based upon the time required to evacuate a designated volume of, e.g., 3,750–4,000 $ft^3$ of vapors from the pugmill 12, it is also preferably manually adjustable so as to permit an operator to alter the timing period as may be required to permit adequate scavenging. Thus, assuming that an operator observes that there are still some vapors in the pugmill 12 at time $T_8$, the operator can lengthen the next evacuation cycle by manually adjusting a dial or the like to modify the timing signal 170 such that the dampers are not returned to their initial positions in the next cycle until a slightly later time $T_8'$.

It can thus be seen that the scavenging system 36 eliminates the need to feed vapors from the pugmill 12 to a baghouse and thus eliminates the accompanying drawbacks of such a process. The contaminated particulates in the pugmill 12 are thus incinerated in the dryer rather than having to be treated elsewhere.

Many changes and modifications could be made to either the RAP feed system or the scavenging system of the present invention without departing from the spirit and scope thereof so long as (1) RAP can be fed to a pugmill or other mixer at a controlled rate so as to avoid overloading of the scavenging system, and/or (2) the scavenging system feeds vapors withdrawn from the pugmill to a dryer or another burner rather than to a baghouse. The scope of such changes will become apparent from the appended claims.

I claim:

1. A batch asphalt plant for producing hot mix asphalt (HMA) using a percentage of recycled asphalt product (RAP) comprising:

A. a virgin aggregate storage bin;

B. a pugmill which receives virgin aggregate from said storage bin;

C. a RAP storage system positioned in the vicinity of said pugmill; and

D. conveyor means for feeding RAP from said RAP storage system to said pugmill at a controlled, variable rate.

2. A batch asphalt plant as defined in claim 1, wherein said conveyor means comprises a variable speed conveyor which transports RAP from said RAP storage system to said pugmill.

3. A batch asphalt plant as defined in claim 2, wherein said variable speed conveyor comprises a belt and a variable speed drive system which drives said belt.

4. A batch asphalt plant as defined in claim 2, wherein said RAP storage system further comprises A. a RAP weigh hopper which stores a designated amount of RAP, B. a RAP holding hopper positioned between said RAP weigh hopper and said variable speed conveyor, and C. gate means for selectively permitting RAP in said RAP weigh hopper to flow into said RAP holding hopper.

5. A batch asphalt plant as defined in claim 1, wherein said RAP storage system comprises a RAP weigh hopper which stores a designated amount of RAP.

6. A batch asphalt plant as defined in claim 5, wherein said RAP weigh hopper includes load cells which detect the weight of RAP in said RAP weigh hopper.

7. A batch asphalt plant as defined in claim 1, further comprising an aggregate weigh hopper positioned between said virgin aggregate storage bin and said pugmill.

8. A method of producing hot mix asphalt (HMA) using a percentage of recycled asphalt product (RAP) comprising:

A. feeding a designated amount of heated virgin aggregate to a pugmill;

B. feeding RAP to said pugmill at a controlled, variable rate;,

C. mixing said heated virgin aggregate and said RAP in said pugmill to produce said HMA; and D. discharging said HMA from said pugmill.

9. A method as defined in claim 8, further comprising adjusting the feed rate of said RAP to said pugmill.

10. A method as defined in claim 8 wherein said feeding step comprises

A. feeding said RAP from a RAP weigh hopper to a RAP holding hopper, and

B. actuating a variable speed conveyor to convey said RAP from said RAP holding hopper to said pugmill.

11. A method as defined in claim 10, further comprising opening a gate to dump RAP from said RAP weigh hopper into said RAP holding hopper.

12. A method as defined in claim 8, further comprising feeding liquid asphalt to said pugmill.

13. A method as defined in claim 8, further comprising

A. removing from said pugmill vapors released due to evaporation of moisture from said RAP, and B. feeding said vapors to a combustion zone.

14. A method of producing hot mix asphalt (HMA) using a percentage of recycled asphalt product (RAP) comprising:

A. feeding a designated amount of heated virgin aggregate to a pugmill;

B. feeding RAP to said pugmill at a controlled, variable rate;

C. mixing said heated virgin aggregate and said RAP in said pugmill to produce said HMA;

D. discharging said HMA from said pugmill; and

E. adjusting the feed rate of said RAP to said pugmill, wherein said adjusting step comprises adjusting said feed rate to reduce steam levels, produced in said pugmill due to vaporization of moisture in said RAP, to acceptable levels.

15. A method as defined in claim 14, herein said adjusting step comprises manually adjusting said feed rate.

16. A method as defined in claim 14, wherein said adjusting step comprises adjusting the speed of a variable speed conveyor delivering RAP to said pugmill.

17. A method of producing hot mix asphalt (HMA) using a percentage of recycled asphalt product (RAP) comprising:

A. feeding a designated amount of heated virgin aggregate to a pugmill:

B. feeding RAP to said pugmill at a controlled, variable rate;

C. mixing said heated virgin aggregate and said RAP in said pugmill to produce said HMA;

D. discharging said HMA from said pugmill;

E. feeding RAP into a RAP weigh hopper;

F. detecting the amount of RAP in said RAP weigh hopper; and

G. terminating the feed of RAP to said RAP weigh hopper upon the detection of a designated amount of RAP in said RAP weigh hopper.

18. A method as defined in claim 17, wherein

A. said step of feeding RAP to said RAP weigh hopper comprises actuating an electric motor to drive a conveyor which conveys said RAP to said RAP weigh hopper, B. said detecting step comprises weighing said RAP weigh hopper, and C. said terminating step comprises deactuating and braking said electric motor.

19. A system comprising:

A. a pugmill having a vapor outlet;

B. a burner having a combustion zone;

C. a vapor scavenging system including (A) a ductwork assembly having a first inlet connected to said vapor outlet of said pugmill, a second inlet connected to the ambient atmosphere, and an outlet connected to said combustion zone of said burner; and (B) a blower which draws vapors from said pugmill, through said ductwork assembly, and into said burner; and D. first and second dampers which control the flow of vapors from said first and second inlets of said ductwork assembly to said outlet.

20. A vapor scavenging system as defined in claim 19, further comprising cylinders which open and close said dampers.

21. A vapor scavenging system as defined in claim 19, further comprising means for correlating damper operation such that said second damper is closed when said first damper is open.

22. A vapor scavenging system as defined in claim 21, wherein said means for correlating comprises a timer which determines the period for which said first damper is open and said second damper is closed.

23. A vapor scavenging system as defined in claim 22, wherein said timer is manually adjustable.

24. A vapor scavenging system as defined in claim 19, wherein said burner supplies heat to a dryer supplying heated and dried aggregate to said pugmill.

25. A batch asphalt plant for producing hot mix asphalt (HMA) using a percentage of recycled asphalt product (RAP) comprising:

A. a dryer which heats and dries virgin aggregate, said dryer having a virgin aggregate inlet, a virgin aggregate outlet, and a combustion air inlet;

B. a tower;

C. a virgin aggregate storage bin mounted on said tower and receiving virgin aggregate from said dryer;

D. a pugmill receiving virgin aggregate from said storage bin;

E. a RAP storage system mounted on said tower;

F. conveyor means for feeding RAP from said RAP storage system to said pugmill at a controlled, variable rate; and G. a scavenging system including (A) a ductwork assembly having an inlet connected to said pugmill and an outlet connected to said combustion air inlet of said dryer, and (B) a blower which draws vapors from said pugmill, through said ductwork assembly, and into said combustion air inlet of said dryer.

* * * * *